US007800007B2

(12) United States Patent
Soundararajan et al.

(10) Patent No.: US 7,800,007 B2
(45) Date of Patent: Sep. 21, 2010

(54) CIRCUIT BREAKER SUBASSEMBLY APPARATUS

(75) Inventors: Narayansamy Soundararajan, Hyderabad (IN); Girish Hassan Mruthunjaya, Farmington, CT (US); Yatin Vilas Newase, Pune (IN)

(73) Assignee: General Electric Company, Schenectady, NY (US)

( * ) Notice: Subject to any disclaimer, the term of this patent is extended or adjusted under 35 U.S.C. 154(b) by 683 days.

(21) Appl. No.: 11/768,611

(22) Filed: Jun. 26, 2007

(65) Prior Publication Data

US 2009/0000933 A1 Jan. 1, 2009

(51) Int. Cl.
*H01H 5/00* (2006.01)

(52) U.S. Cl. ..... 200/400; 200/244

(58) Field of Classification Search ..... 200/400, 200/401

See application file for complete search history.

(56) References Cited

U.S. PATENT DOCUMENTS 3,876,847 A * 4/1975 Dykes et al. ..... 200/400
4,644,120 A * 2/1987 Tedesco ..... 200/401
4,713,508 A 12/1987 Baginski et al.
5,281,776 A 1/1994 Morel et al.
5,300,907 A 4/1994 Nereau et al.
5,539,167 A * 7/1996 Hood et al. ..... 200/244
6,262,644 B1 7/2001 Castonguay et al.
6,346,868 B1 2/2002 Castonguay et al.
6,373,010 B1 4/2002 Narayanan et al.
6,388,547 B1 5/2002 Castonguay et al.
6,423,917 B2 7/2002 Narayanan et al.
6,559,743 B2 5/2003 Narayanan et al.
6,960,731 B2 * 11/2005 Azzola et al. ..... 200/244
7,189,935 B1 3/2007 Hassan et al.
7,683,281 B2 * 3/2010 Bresciani et al. ..... 200/400

FOREIGN PATENT DOCUMENTS

CN 1416150 5/2003

* cited by examiner

*Primary Examiner*—Michael A Friedhofer
*Assistant Examiner*—Lheiren Mae A Caroc
(74) *Attorney, Agent, or Firm*—Cantor Colburn LLP

(57) ABSTRACT

A circuit breaker subassembly is disclosed. The subassembly includes a base, an operating mechanism, a one-piece non-conductive rotor disposed within the base, and a plurality of sets of contact arms supported by the rotor. The rotor is disposed in operable connection with the operating mechanism and includes a rotational degree of freedom relative to the base with portions of the rotor disposed between each set of the plurality of sets of contact arms to define separation portions. The operating mechanism includes a frame disposed within the base, a cradle in pivotal connection with the frame, an upper link in pivotal connection with the cradle, and a lower link having a first end and a second end, the first end in pivotal connection with the upper link and the second end in pivotal connection with the rotor at the separation portions.

17 Claims, 13 Drawing Sheets

CIRCUIT BREAKER SUBASSEMBLY APPARATUS

BACKGROUND OF THE INVENTION

The present disclosure relates generally to circuit breakers and particularly to circuit breaker operation mechanism attachment arrangements.

Multipole circuit breakers configured to protect multiphase electrical circuits are known in the electrical circuit protection industry. The variety of constructions of multipole circuit breakers include blow open and non-blow open contact arms, overcentering and non-overcentering contact arms, single contact pair arrangements with the contact pair at one end of a contact arm and a pivot at the other end thereof, double contact pair arrangements (referred to as rotary breakers) with a contact pair at each end of a contact arm and a contact arm pivot intermediate (typically centrally located between) the two ends, single housing constructions with the circuit breaker components housed within a single case and cover, and cassette type constructions (referred to as cassette breakers) with the current carrying components of each phase housed within a phase cassette and each phase cassette housed within a case and cover that also houses the operating mechanism. Multipole circuit breakers are generally available in two, three, and four pole arrangements, with the two and three pole arrangements being used in two and three phase circuits, respectively. Four pole arrangements are typically employed on three phase circuits having switching neutrals, where the fourth pole operates to open and close the neutral circuit in a coordinated arrangement with the opening and closing of the primary circuit phases.

An amount of energy available to close the contact arms is typically related to forces exerted by springs included within an operating mechanism of the circuit breaker. One manner to increase this energy is to increase a size of the springs, which typically results in an accompanying undesired increase of mechanism size. Further, many circuit breakers commonly employ operating mechanisms that incorporate components disposed proximate the contact arms, such as central pivots and cross pins that extend in a direction along an axis of a rotor and are disposed across multiple poles of the circuit breaker, proximate more than one set of contact arms corresponding to more than one pole. As a length of the cross pins, utilized to drive rotors that correspond to each of the phases, from the operating mechanism increases, deflection of the cross pins can allow contact depression variation between different phases, thereby resulting in contact resistance variation. Further, openings between separate poles to allow for disposal of central pivots and cross pins may reduce a dielectric strength between poles of the circuit breaker. While existing circuit breakers are considered suitable for their intended purpose, the art of circuit breakers may be improved by providing an operating arrangement that overcomes these drawbacks.

BRIEF DESCRIPTION OF THE INVENTION

An embodiment of the invention includes a circuit breaker subassembly. The subassembly includes a base, an operating mechanism, a one-piece non-conductive rotor disposed within the base, and a plurality of sets of contact arms supported by the rotor. The rotor is disposed in operable connection with the operating mechanism and includes a rotational degree of freedom relative to the base with portions of the rotor disposed between each set of the plurality of sets of contact arms to define separation portions. The operating mechanism includes a frame disposed within the base, a cradle in pivotal connection with the frame, an upper link in pivotal connection with the cradle, and a lower link having a first end and a second end, the first end in pivotal connection with the upper link and the second end in pivotal connection with the rotor at the separation portions.

Another embodiment of the invention includes a circuit breaker operating mechanism. The operating mechanism includes a frame, a cradle in pivotal connection with the frame via a first pivot, an upper link in pivotal connection with the cradle, a lower link in pivotal connection with the upper link via a toggle pin, and a handle yoke in pivotal connection with the frame via a second pivot. The operating mechanism further includes a spring assembly including an upper spring anchor operably connectable with the handle yoke, a lower spring anchor in operable connection with the toggle pin, a first extension spring, and a second extension spring. The first extension spring has a first end in operable connection with the upper spring anchor and a second end in operable connection with the lower spring anchor. The second extension spring is disposed coaxial to and having spring windings surrounding the first extension spring and includes a first end in operable connection with the upper spring anchor and a second end in operable connection with the lower spring anchor.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention includes a multi-pole rotor assembly support that provides a reduction in variation of contact closure depression, and therefore, reduction in variation of contact resistance between the poles of a multi-pole circuit breaker. In an embodiment, an interface between the operating mechanism and the rotor assembly is physically and electrically isolated from contact arms of the multiple poles. In an embodiment, mating bearing surfaces of the rotor assembly and a base of the circuit breaker provide a central support to the rotor assembly. Another embodiment provides the rotor assembly made from non-conductive material having a blind hole in which a pin connects the rotor to the operating mechanism, thereby isolating the operating mechanism from the contact arms. A further embodiment of the invention includes extension springs disposed within the mechanism in a coaxial parallel arrangement, or one inside another, to provide increased closing energy within a given space.

Figure 1:
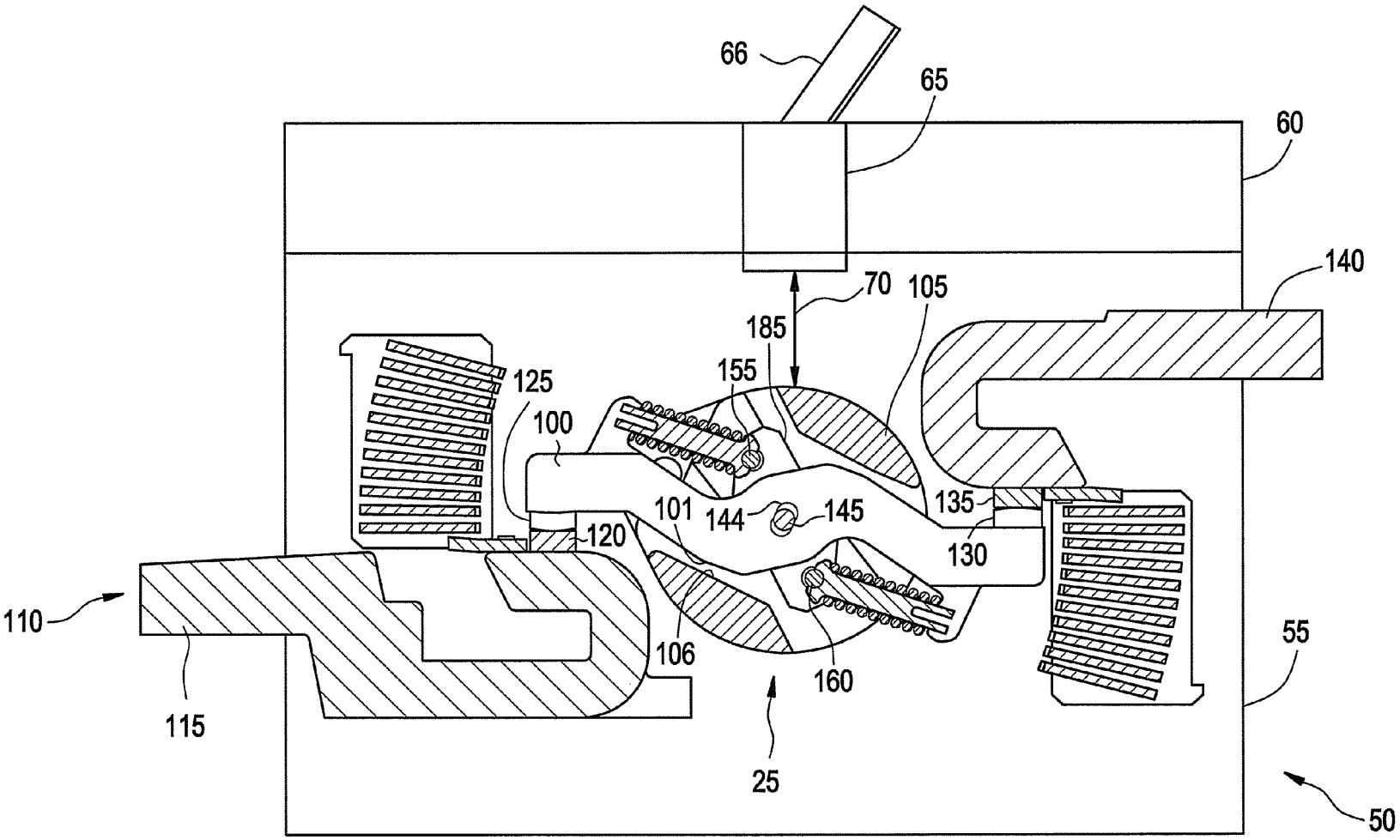
FIG. 1 depicts in cross section view a schematic circuit breaker incorporating an exemplary contact arm assembly in accordance with an embodiment of the invention with the contact arm in the CLOSED position.

A circuit breaker 50 (also herein referred to as a circuit breaker subassembly) is depicted in FIG. 1 having a base 55 and a cover 60. Within the base 55 and cover 60 are a contact arm assembly 25, a line strap 115, and a load strap 140. In the example of FIG. 1, an operating mechanism 65 with handle 66 is used via a linkage 70 to turn the circuit breaker 50 ON and OFF in a manner that will be described further below. FIG. 1 illustrates the situation where the operating mechanism 65 has positioned the contact arm assembly 25 in the ON position, creating a CLOSED conduction path 110. The conduction path 110 includes a contact arm 100 with movable contacts 125, 130 at opposite ends thereof, the line strap 115, the load strap 140, a fixed contact 120 disposed on the line strap 115, and a fixed contact 135 disposed on the load strap 140. Contact arm 100 includes a slotted pivot hole 144 that is centrally disposed between movable contacts 125, 130. When circuit breaker 50 is electrically connected to an electrical circuit via connectors (not shown) on line strap 115 and load strap 140, and is turned ON, the electrical current flows through line strap 115, fixed contact 120, movable contact 125, contact arm 100, movable contact 130, fixed contact 135, and load strap 140. Operating mechanism 65 opens and closes conduction path 110 via linkage 70 by rotating a rotor 105, which is coupled to and in turn rotates contact arm 100 about its central axis (designated generally by reference numeral 145). In an embodiment, the rotor 105 is made from non-conductive material. The relationship between contact arm 100 and rotor 105 will be discussed further below.

While FIG. 1 illustrates only a single contact arm 100, it will be appreciated that this is for illustration purposes only, as will be evident by the discussion below.

Figure 2:
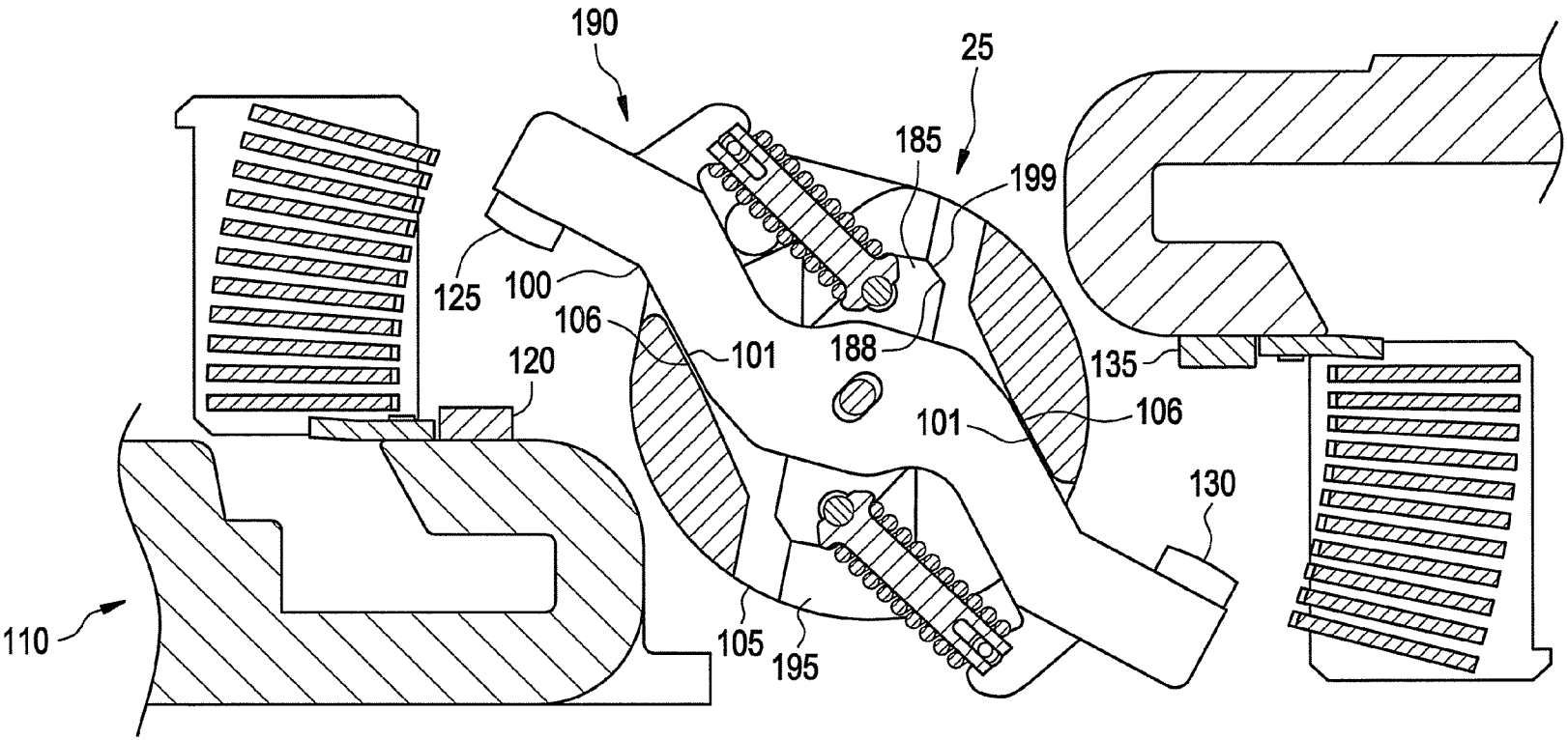
FIG. 2 depicts in cross section view the contact arm assembly of FIG. 1 with the contact arm in the OPEN position.

Referring now to FIG. 2, which illustrates an example where the operating mechanism 65 (not specifically shown in FIG. 2) has been placed in the OFF position, thereby causing the linkage 70 to rotate the rotor 105 in a clockwise direction to create an OPEN conduction path 110. As the rotor 105 rotates clockwise from the position shown in FIG. 1, the initial rotation of rotor 105 does not cause rotation of the contact arm 100 due to a clearance between the rotor 105 and the contact arm 100, shown in FIG. 1 by a separation between surfaces 101 and 106. However, when surface 106 of the rotor 105 contacts surface 101 of the contact arm 100, the rotor 105 and contact arm 100 rotate together, which causes the movable contacts 125, 130 to separate from the fixed contacts 120, 135, thereby resulting in an interruption of the conduction path 110.

Figure 3:
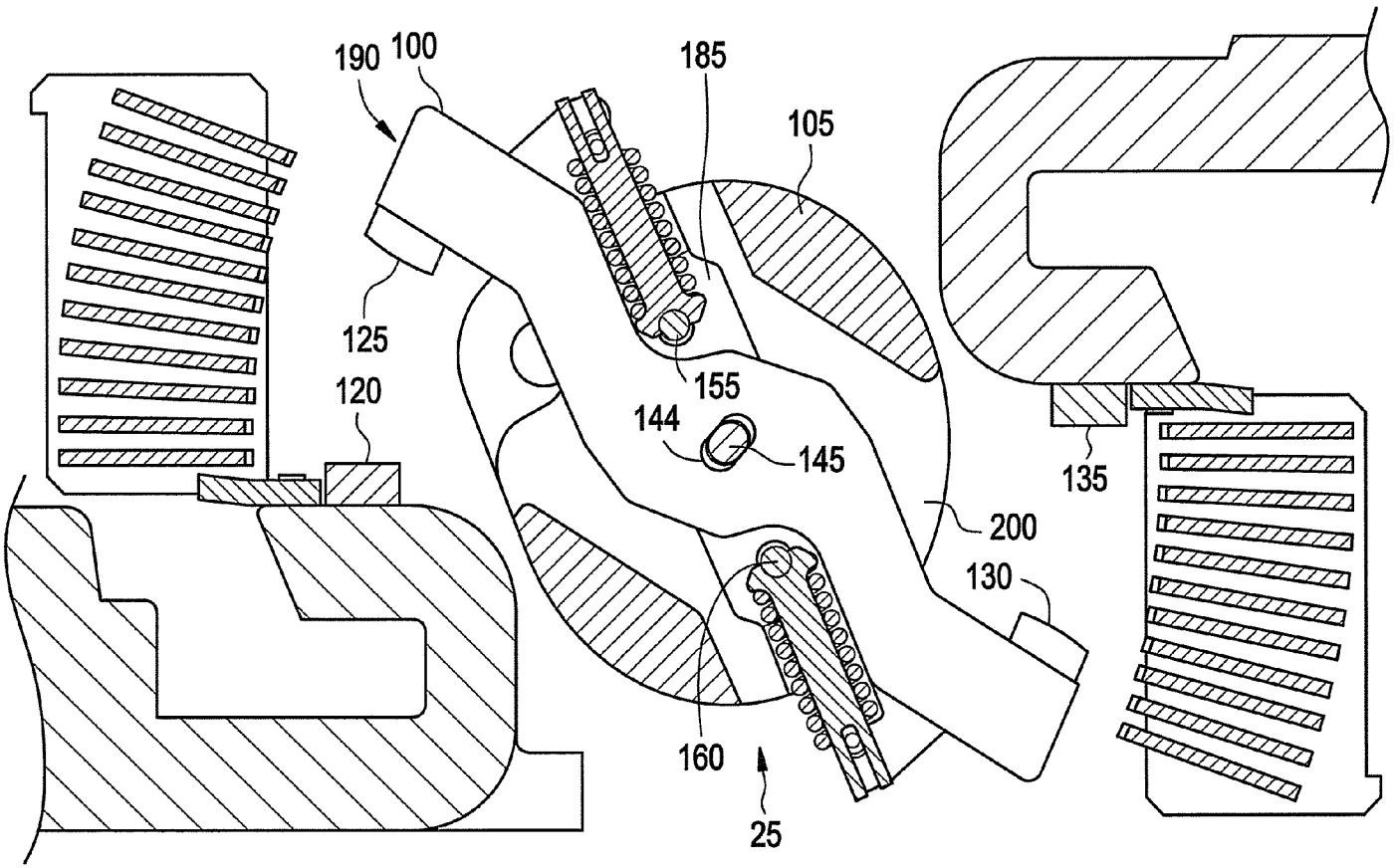
FIG. 3 depicts in cross section view the contact arm assembly of FIG. 1 with the contact arm in the BLOW OPEN position.

FIG. 3 illustrates an example of the contact arm assembly 25 immediately following the occurrence of an over current condition within the circuit breaker 50 that causes the contact arm 100 to blow open. The magnetic repulsion forces generated between the fixed contacts 120, 135 and the movable contacts 125, 130, between the line strap 115 and the contact arm 100, and between the load strap 140 and the contact arm 100, cause the contact arm 100 and associated movable contacts 125, 130 to rotate about a pivot pin 145, which is disposed in pivot hole 144, in the clockwise direction to the BLOW OPEN position. Note that immediately following the over current event depicted in FIG. 3, the rotor 105 and side plate 185 have not changed position from the CLOSED position shown in FIG. 1.

Figure 4:
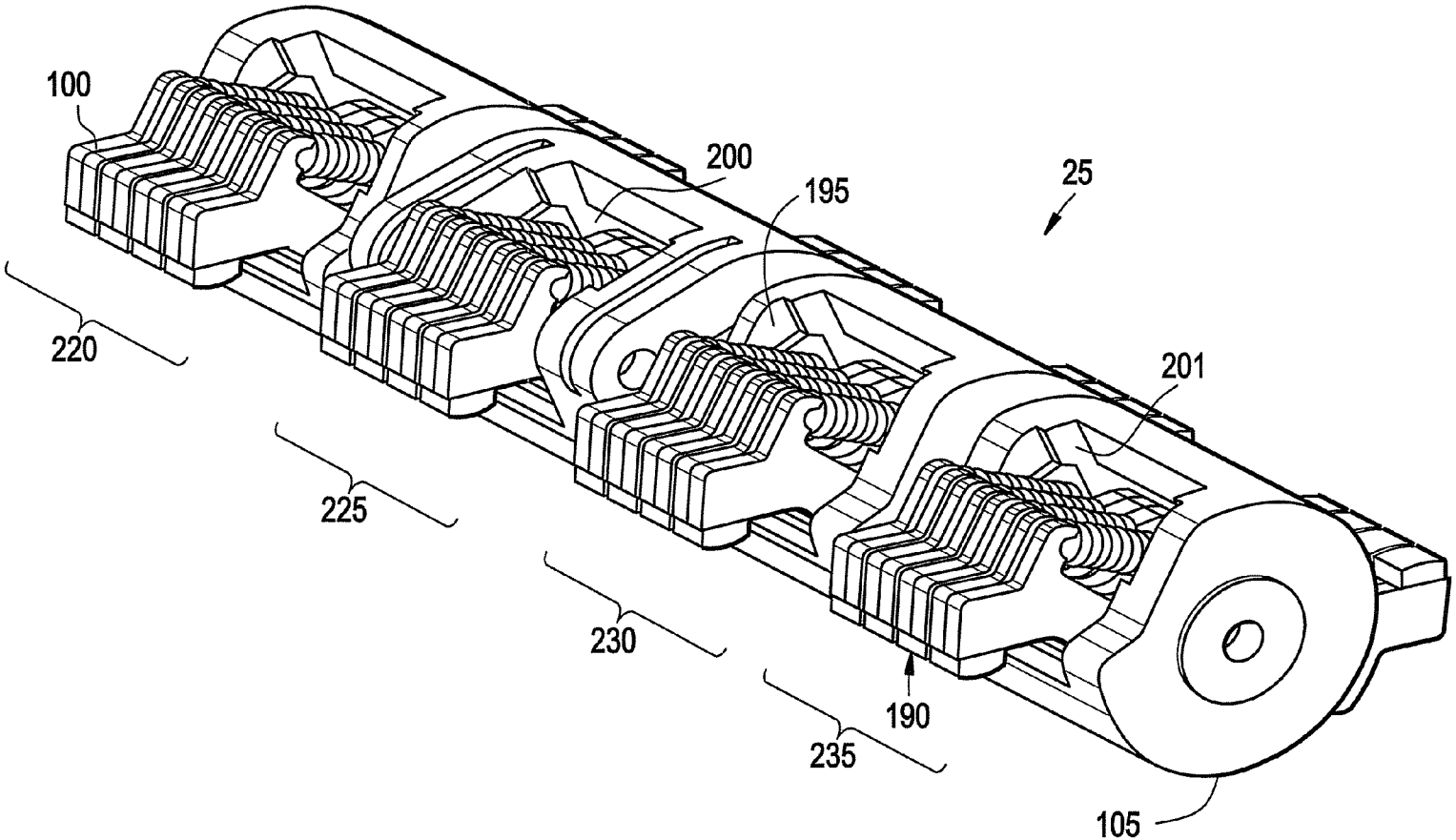
FIG. 4 depicts a top perspective view of an exemplary contact arm assembly in accordance with an embodiment of the invention.

Referring now to FIG. 4, a four-pole configuration of the contact arm assembly 25 is depicted in isometric view, which a one-piece rotor 105 and four contact arm modules 190. While the embodiment described herein depicts four contact arm modules 220, 225, 230, and 235 (herein referred to generally as contact arm module 190), which may serve to protect phases A, B, C and neutral within a four-pole circuit breaker, it will be appreciated that the disclosed invention is also applicable to other circuit breakers such as a one, two, or three pole circuit breaker, for example.

Figure 5:
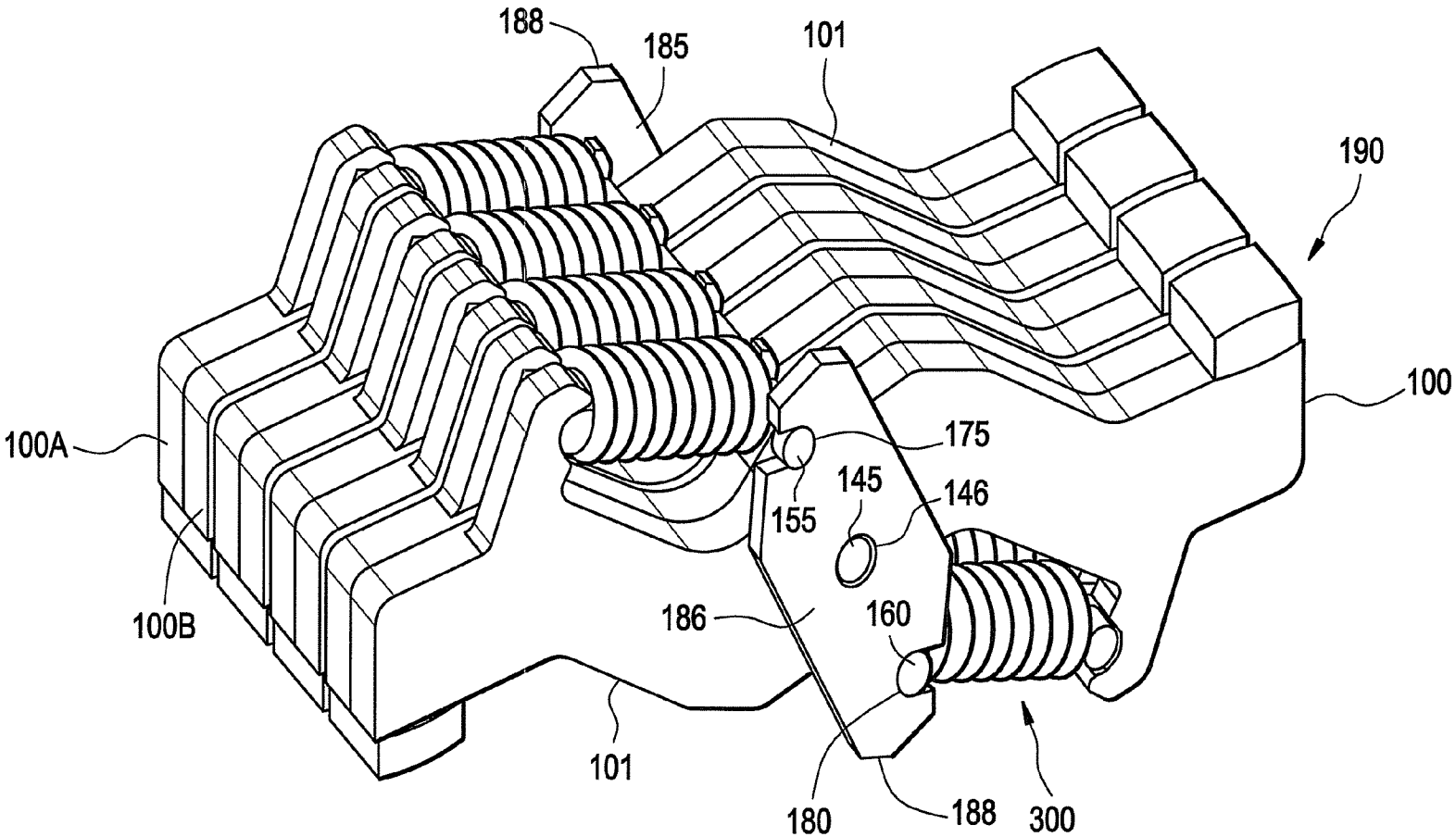
FIG. 5 depicts a top perspective view of an exemplary contact arm module in accordance with an embodiment of the invention.

An exemplary contact arm module 190 is shown in FIG. 5, which includes four contact arms 100, eight captivated spring subassemblies 300 (two per contact arm 100), two side plates 185, 186 with notches 175, 180, two spring supports (pins) 155, 160, and one pivot pin 145. Each side plate 185, 186 is located on an opposing side of the set of contact arms 100. The pivot pin 145 extends through the entire width of the contact arm module 190 from pivot hole 146 in side plate 186 through the pivot hole 144 in each contact arm 100 to pivot hole 146 in side plate 185. While pivot holes 144 in contact arms 100 and pivot hole 146 in side plate 185 are not visible in FIG. 5, their presence will be readily understood by one skilled in the art with reference to other discussions and illustrations presented herein. Spring supports 155, 160 extend the width of the entire contact arm module 190 from one side plate 186 to the other side plate 185. The spring supports 155, 160 are engaged to side plates 185, 186 via notches (also herein referred to as support anchors) 175, 180. In an embodiment, each contact arm 100 is made by laminating two contact arms 100A and 100B together. While the embodiment described and illustrated herein depicts two contact arm laminations 100A, and 100B, four contact arms 100, and two side plates 185, 186, it will be appreciated that the disclosed invention is also applicable to an alternate number of contact arms, contact arm laminations, and side plates. For example, applications that may require different current ratings could utilize fewer or greater numbers of contact arms 100 or contact arm laminations 100A, 100B, as appropriate to carry different currents. For example, an embodiment may have only one contact arm 100 having a single lamination 100A, multiple contact arms 100 each having a single lamination 100A, a single contact arm 100 having a plurality of laminations 100A, 100B, or multiple contact arms 100 each having a plurality of laminations 100A, 100B. Further, it may be desirable in some applications to include additional side plates 185, 186.

Figure 6:
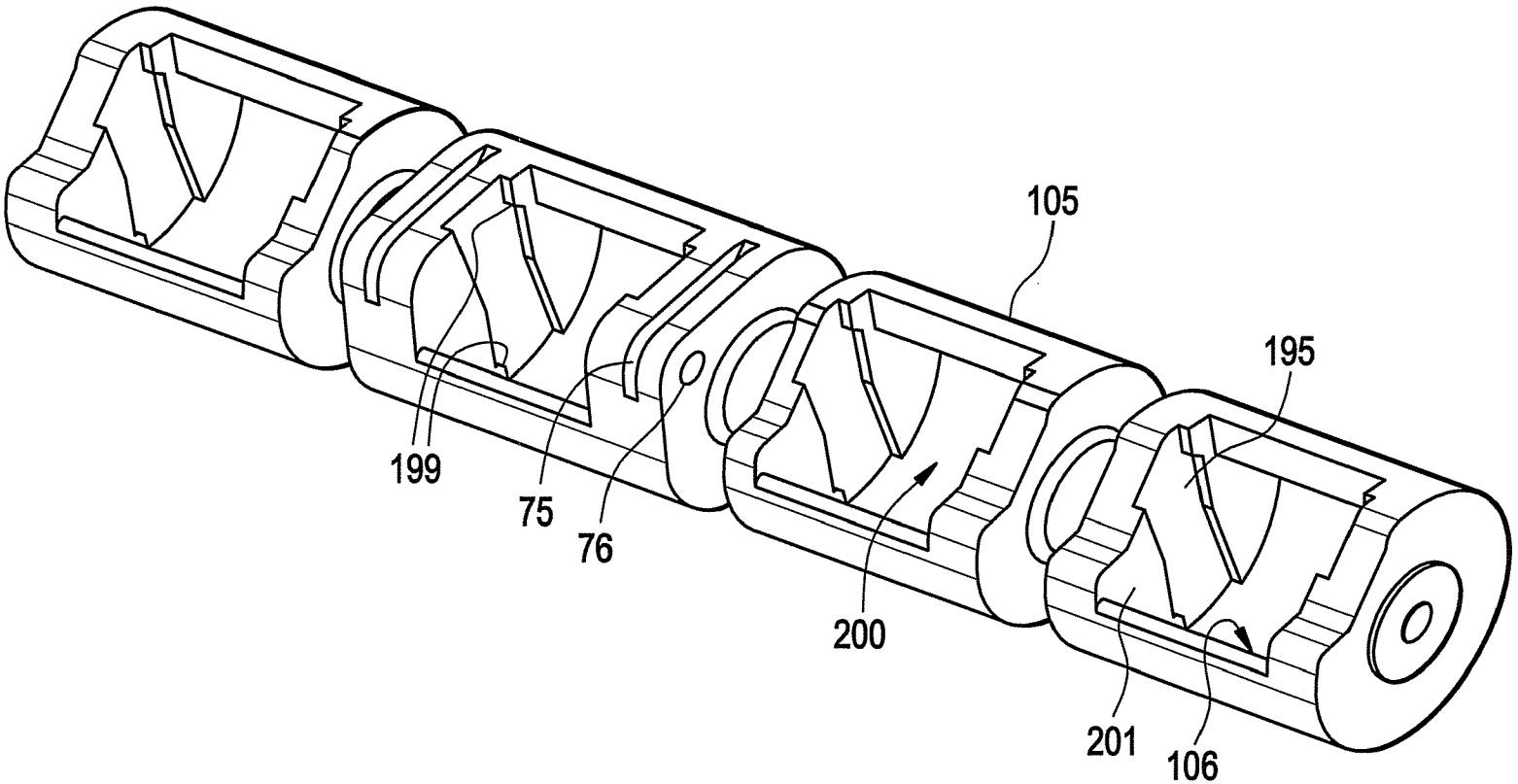
FIG. 6 depicts a top perspective view of an exemplary rotor in accordance with an embodiment of the invention.

FIG. 6 illustrates an exemplary one-piece rotor 105. Within the rotor 105 there exist four cavities 200 for the insertion of contact arm modules 190 (also herein referred to as sets of contact arm arms). Slot 75 and pin hole 76 are provided to allow the rotor 105 to be mechanically connected with, and electrically isolated from, the linkage 70 and operating mechanism 65, as will be described further below. Further, each cavity 200 has sidewalls 201 in which there exists a recess 195. The geometry of the recesses 195 include rotor captivating edges 199. These edges interface with mating side plate captivating edges 188 (depicted in FIG. 5 on side plate 186) to help retain the side plates 185, 186 within the rotor 105. Each of the recesses 195 is designed to accept and contain the geometry of the side plates 185, 186 of the contact arm module 190 shown in FIG. 5. In response to the close fit between the recess 195 and the side plates 185, 186, the side plates 185, 186 will rotate with the rotor 105. As used here, the term "close fit" represents a minimum clearance condition with part tolerances considered. In another embodiment, a different fit may be selected, for example an interference fit. While the embodiment described herein depicts a single one-piece rotor 105 with four cavities 200, which in the illustrated embodiment contains four contact arm modules 190 to service phases A, B, C, and neutral within a four-pole circuit breaker, it will be appreciated that the disclosed invention is also applicable to other circuit breakers that may require the functionality of a double-break rotary contact arm, such as a one, two, or three pole circuit breaker for example.

FIG. 6, in conjunction with FIG. 5, depict sidewalls 201 within each cavity 200 absent any openings between the cavities 200. Therefore, a length of the pivot 145 of each contact arm module 190 is no greater than the distance between the recesses 195. Such openings between cavities 200 may result in a reduced dielectric strength between the poles represented by each contact arm module 190. Accordingly, use of the one-piece, non-conductive rotor absent openings between poles as described herein provides an increased dielectric strength between poles as compared to a rotor or set of rotors that include openings between the contact arm modules 190 corresponding to different circuit breaker 50 poles.

Figure 7:
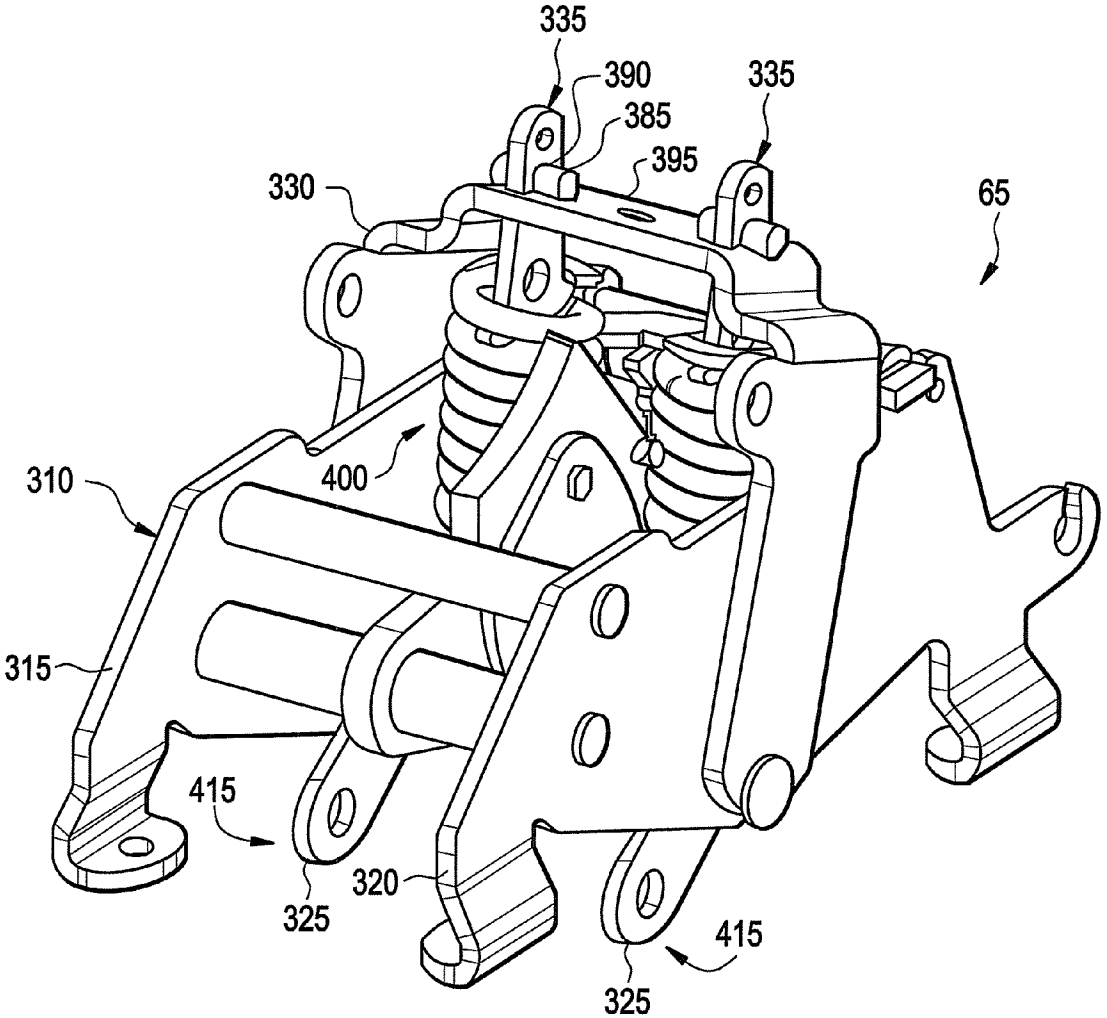
FIG. 7 depicts a top perspective view of a circuit breaker operating mechanism in accordance with an embodiment of the invention.

Referring now to FIG. 7, an embodiment of the operating mechanism 65 is depicted. The operating mechanism has a frame 310 including a first side 315 and a second side 320 disposed within the base 55. In the embodiment of the operating mechanism 65 depicted in FIG. 7, the linkage 70 (depicted schematically in FIG. 1) that operatively connects the operating mechanism 65 to the rotor 105 includes lower links 325. In an embodiment, the lower links 325 are disposed between the sides 315, 320. The operating mechanism 65 further includes a handle yoke 330 and two spring assemblies 335, which will be described further below.

Figure 8:
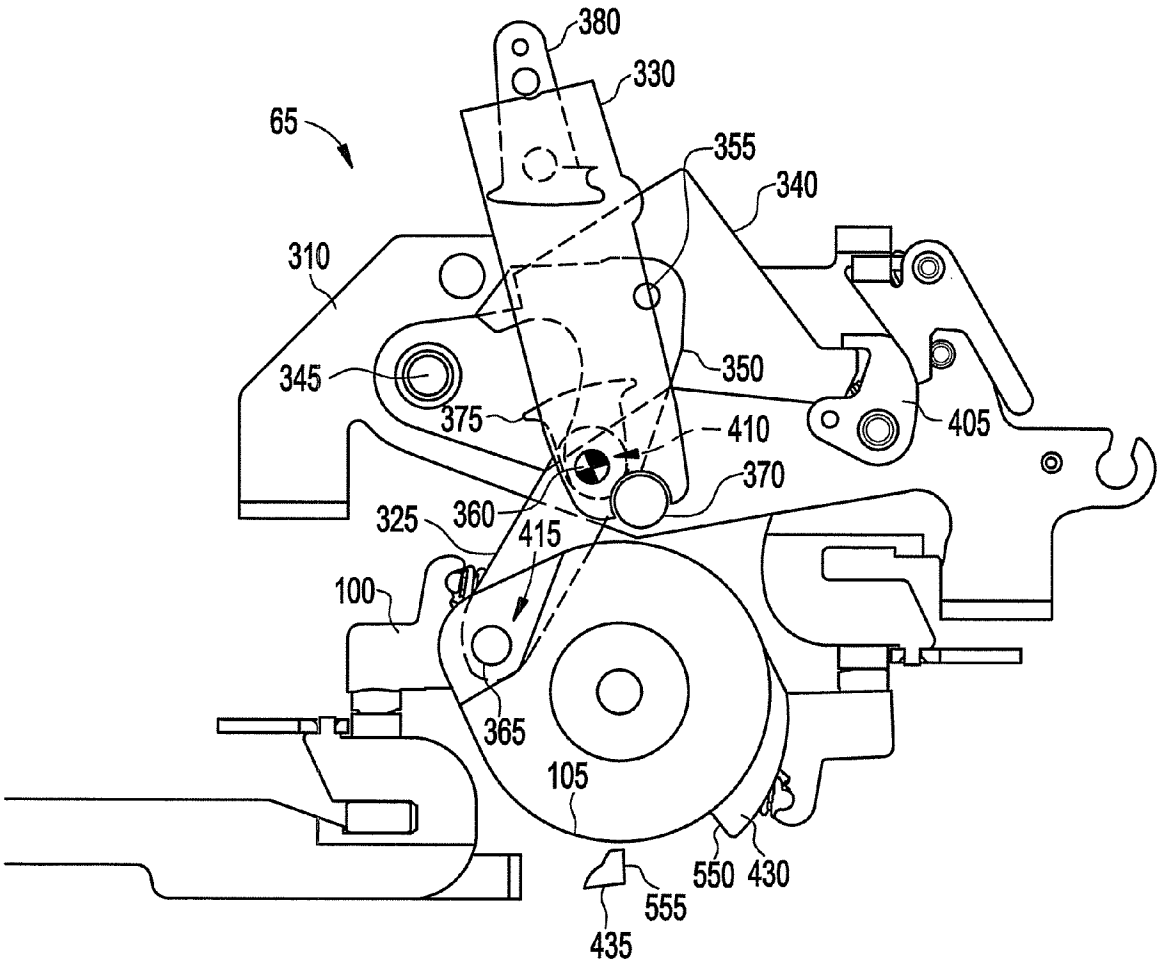
FIG. 8 depicts a schematic view of a circuit breaker operating mechanism and rotary contact arm assembly with the operating mechanism in an ON position and the contact arm in the CLOSED position in accordance with an embodiment of the invention.

FIG. 8 depicts an embodiment of the operating mechanism 65 in operable connection with the rotor 105 corresponding to the ON position of the mechanism 65 (with springs removed for clarity of illustration). The mechanism 65 includes a cradle 340 pivotally connected to the frame 310 via a pivot 345. An upper link 350 is pivotally connected to the cradle via pivot 355. The upper link 350 is further pivotally connected to a toggle pivot 360. The lower link 325 is pivotally connected between the toggle pivot 360 and a pivot 365 of the rotor 105. The handle yoke 330 is pivotally connected to the frame 310 via pivot 370. A lower spring anchor 375 of the spring assembly 335 is in operable connection to the toggle pivot 360 while an upper spring anchor 380 of the spring assembly 335 is operably connectable to the handle yoke 330 via an engagement feature 385, such as a pin through a retention feature 390, such as a hole, in contact with an outer surface 395 of the handle yoke 330 (best seen with reference to FIG. 7). Springs 400 disposed between the lower spring anchor 375 and upper spring anchor 380 are extension springs, and therefore, in an extended state, provide an attractive bias force between the lower spring anchor 375 and upper spring anchor 380. A primary latch 405 retains the position of the cradle 340, preventing it from rotating about pivot 345.

Figure 9:
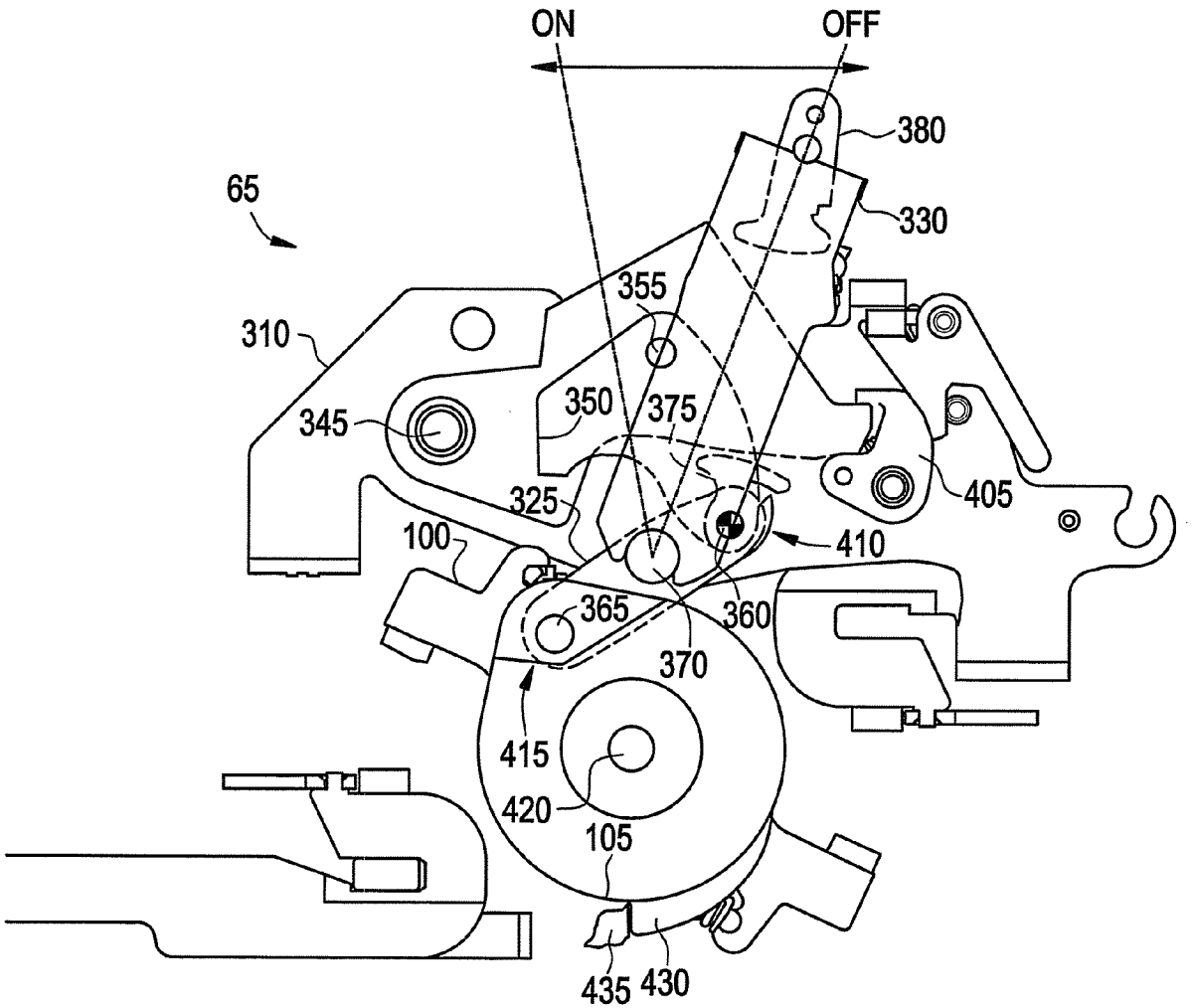
FIG. 9 depicts a schematic view of a circuit breaker operating mechanism and rotary contact arm assembly with the operating mechanism in an OFF position and the contact arm in the OPEN position in accordance with an embodiment of the invention.

FIG. 9 depicts the embodiment of the operating mechanism 65 and rotor 105 of FIG. 8, corresponding to the OFF position of the mechanism 65. With reference to FIG. 9 in conjunction with FIG. 8, the handle yoke 330 has been displaced from the ON position (as shown in FIG. 8) to the OFF position. Accordingly, the attractive bias force between the upper spring anchor 380 retained within the handle yoke 330 and the lower spring anchor 375 is applied to the toggle pivot 360 (via the pivotal connection with the lower spring anchor 375) and directed toward the upper spring anchor 380. The attractive bias force applied to the toggle pivot 360 is transferred to the upper link 350 and lower link 325 and thereby results in application to the upper link 350 of a moment in a counterclockwise direction about the pivot 355. The applied moment causes rotation of the upper link 350 and revolution of the toggle pivot 360 about pivot 355 from the ON position depicted in FIG. 8 to the OFF position depicted in FIG. 9. Accordingly, motion of the toggle pivot 360 causes a corresponding change in position of a first end 410 of the lower link 325 pivotally connected to the toggle pivot 360. In response to the change in position of the first end 410 of the lower link 325, a position of the second end 415, pivotally connected to the rotor 105 via pivot 365 is thereby changed, such that the second end 415, the pivot 365, and the rotor 105 rotate about pivot 420 of the rotor 105. Accordingly (as described above) the contact arm 100 is displaced to the OPEN circuit position.

Figure 10:
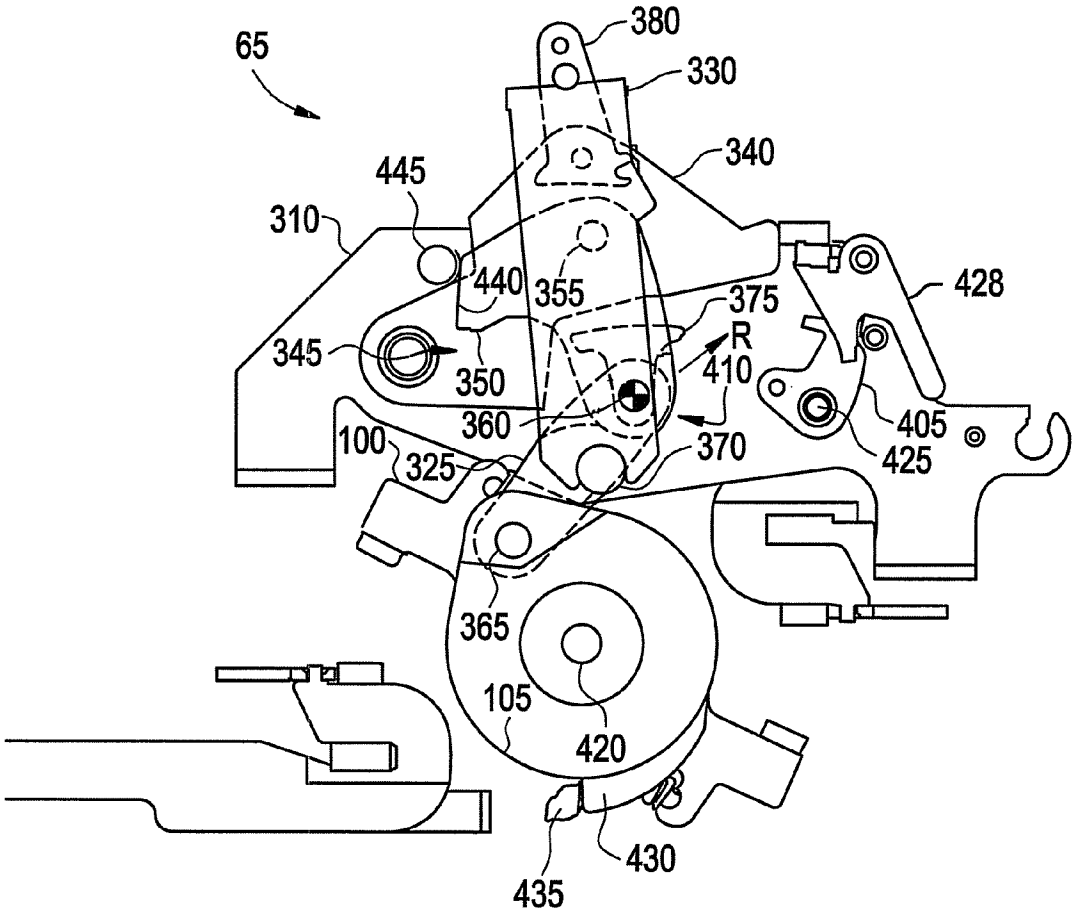
FIG. 10 depicts a schematic view of a circuit breaker operating mechanism and rotary contact arm assembly with the operating mechanism in a TRIPPED position and the contact arm in the OPEN position in accordance with an embodiment of the invention.

FIG. 10 depicts the embodiment of the operating mechanism 65 and rotor 105 of FIGS. 8 and 9, corresponding to a TRIPPED position of the mechanism 65. With reference to FIG. 10 in conjunction with FIGS. 8 and 9, the handle yoke 330 has been displaced from the ON position (as shown in FIG. 8) to the TRIPPED position, which represents a small clockwise rotation of the handle yoke 330 about the pivot 370. In response to a trip event, such as a short circuit, the primary latch 405 is rotated clockwise about pivot 425 via a secondary latch 428 to release the cradle 340, in a manner that will be appreciated by one of skill in the art. The attractive bias force between the upper spring anchor 380 retained within the handle yoke 330 and the lower spring anchor 375 is applied to the toggle pivot 360. The attractive bias force applied to the toggle pivot 360, directed toward the upper spring anchor 380 retained within the handle yoke 330, is transferred to the upper link 350 and lower link 325, and thereby results in application to the upper link 350 of a moment in a counterclockwise direction about the pivot 355. The attractive bias force transferred to the upper link 350 is also transferred into the cradle 340 to which the upper link 350 is pivotally connected via pivot 355, and thereby results in application to the cradle 340 of a moment in a counterclockwise direction about the pivot 345.

Accordingly, in response to the release of the cradle 340 by the primary latch 405, the applied moment results in a counterclockwise rotation of the cradle 340 about the pivot 345. The counter clockwise rotation of the cradle 340 results in a displacement of the pivot 355, thereby causing displacement of the upper link 350 attached to pivot 355. Displacement of the upper link 350 thereby provides an accompanying displacement of the toggle pivot 360, resulting in displacement of the lower link 325 and rotation of the rotor 105 and contact arm 100 to the OPEN position.

Subsequent to the trip event, mechanism 65 may be reset, and the cradle 340 returned to the position shown in FIGS. 8 and 9 via movement of the handle yoke 330 to the OFF position, as depicted in FIG. 9. A first stop 430 disposed on the rotor 105 and a mating second stop 435 disposed on the base 55, as will be described further below, prevent further rotation of the rotor 105 in a clockwise direction about the pivot 420. As such, the motion of the toggle pivot 360 is constrained to that of rotation of the first end 410 of the lower link 325 about the pivot 365. As the handle yoke 330 is displaced from the TRIPPED position to the OFF position, the attractive bias force applied to the toggle pivot 360 will be progressively directed to the reset force direction R, corresponding to the OFF position of the handle yoke 330. In light of the constraint of motion of the toggle pivot 360, the attractive bias force in direction R will result in a clockwise rotation of the toggle pivot 360 about the pivot 365. Such motion of the toggle pivot 365 will result in application to the upper link 350 of a clockwise moment about pivot 355. Contact of a cam surface 440 of the upper link 350 and roller bar 445 attached to the frame 310 prevents clockwise rotation of the upper link 350 about the pivot 355. Therefore, the clockwise moment applied to pivot 355 is transferred to the cradle 340 about the pivot 345. Accordingly, the cradle 340 rotates in a clockwise motion about the pivot 345 until the cradle 340 is returned to the reset position as depicted in FIG. 9, and captured in such position by the primary latch 405.

Figure 11:
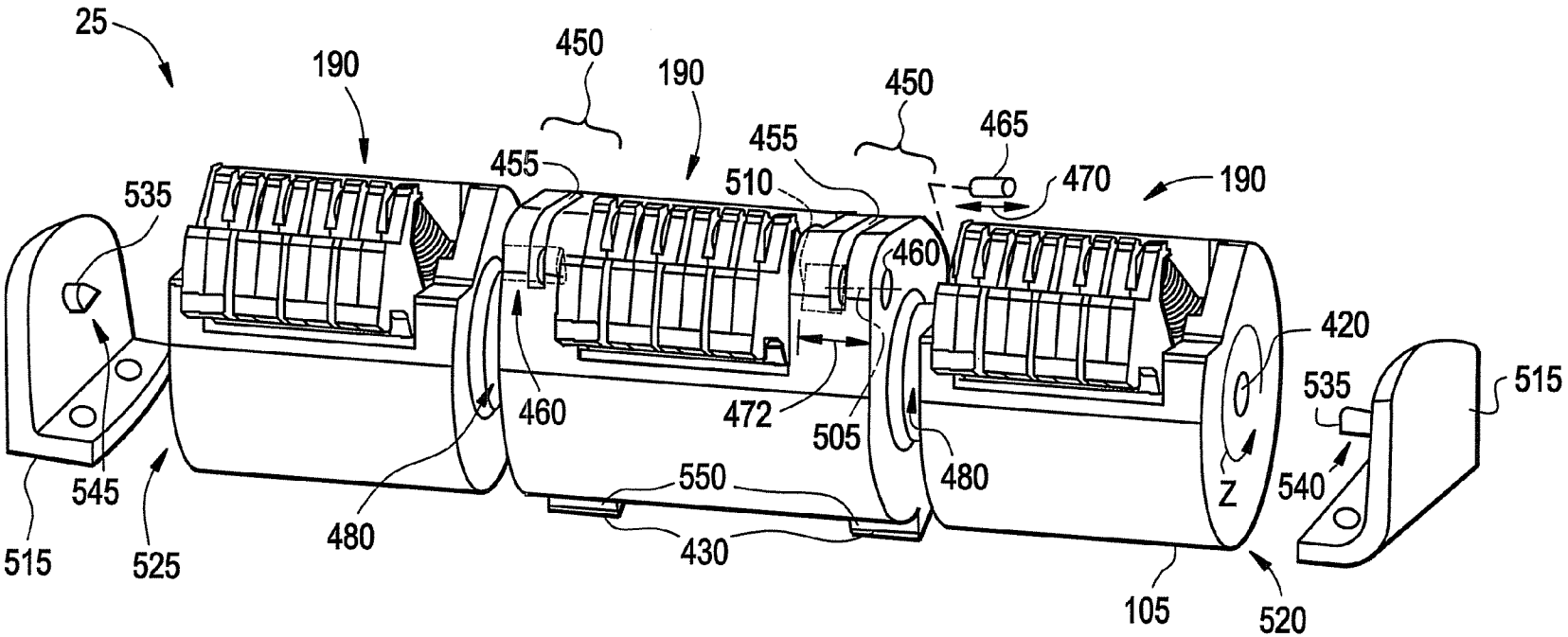
FIG. 11 depicts a side perspective view of a contact arm assembly in accordance with an embodiment of the invention.

FIG. 11 depicts an embodiment of the rotor 105 of the contact arm assembly 25 including a plurality of contact arm modules 190 (also herein referred to as sets of contact arms). An axial direction of the rotor 105, which traverses a plurality of phases associated with the plurality of contact arm modules 190 is indicted by direction line X. Portions 450 of the rotor 105 are disposed between each contact arm module 190 of the plurality contact arm modules 190 and thereby define separation portions 450 between each contact arm module 190. The lower links 325 (best seen with reference to FIG. 7) are in operable connection with the rotor 105 and disposed at axial positions at the separation portions 450 of the rotor 105. The second ends 415 of the lower links 325 are disposed within slots 455 of the separation portions 450 of the rotor 105. Referring back to FIGS. 8 through 10 in conjunction with FIG. 11, lower links 325 are pivotally connected to the rotor 105 via the pivot 365.

In an embodiment, the separation portion 450 includes openings 460, such as holes, and the pivot 365 is a pin 465 disposed within the openings 460 and a matching opening (depicted generally as pivot 365 in FIGS. 8 through 10) disposed at the second end 415 of the lower link 325. In an embodiment the opening 460 is a blind hole, and the pin 465 has a length 470 less than an axial length 472 of the blind hole 460. Therefore, because the length of the pin 465, which is less than the length 472 of the separation portion 450 measured along the axial direction of the rotor 105, the pin 465 does not protrude or extend beyond the opening of the blind hole 460 when the pin 465 is bottomed within the blind hole 460. Accordingly, the pin 465 is disposed is such a fashion to be isolated from the contact arm modules 190, thereby enhancing an isolation of the operating mechanism 65 from the contact arm modules 190 as compared to current mechanisms that include cross pins disposed proximate contact arm modules 190. Additionally, use of the pin 465 that is isolated from the contact arm modules 190 in conjunction with the one-piece rotor 105 eliminates openings utilized within current rotor designs for cross-pins that extend axially through rotors that correspond to each of a plurality of poles. The elimination of such openings between the poles enhances isolation of each contact arm module 190 to the other contact arm modules 190 and thereby increases a dielectric strength of the rotor 105, particularly in response to short circuit conditions. Furthermore, use of the connection arrangement described above, including the one-piece rotor 105, reduces variation of contact depression (and therefore contact resistance variation) that results from a cantilevered deflection of cross-pins that extend axially through rotors that correspond to each of a plurality of poles.

Figure 12:
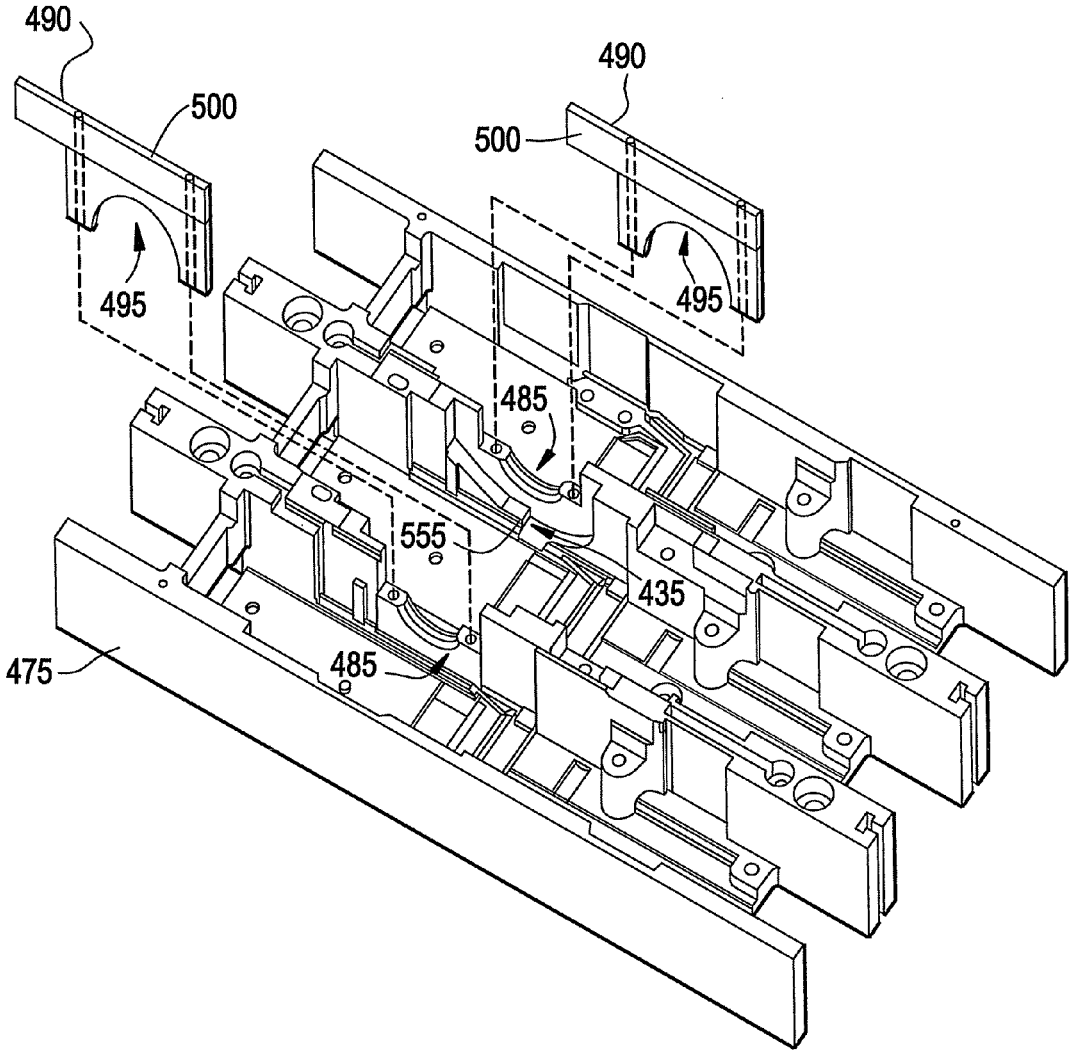
FIG. 12 depicts a top perspective exploded assembly view of a circuit breaker base in accordance with an embodiment of the invention.

FIG. 12 depicts an embodiment of a base 475, such as the base 55 schematically represented in FIG. 1. Referring to FIG. 12 in conjunction with FIG. 11, the rotor 105 includes bearing surfaces 480, also herein referred to as "outer bearing surfaces", and the base 475 includes bearing surfaces 485, also herein referred to as "lower inner bearing surfaces". The outer bearing surfaces 480 mate with the inner bearing surfaces 485 to support the rotor 105 within the base 475. The bearing surfaces 480, 485 define a rotational degree of freedom Z aligned with the axial direction X (best seen with reference to FIG. 11) of the rotor 105 relative to the base 475. In an embodiment, the outer bearing surfaces 480 are disposed proximate the separation portion 450, between two contact arm modules 190 of the plurality of contact arm modules 190.

A set of phase isolators 490 disposed within and attached to the base 475 provide a physical insulating barrier between each contact arm module 190, corresponding to different phases of an electrical distribution system (not shown). The phase isolators 490 include bearing surfaces 495, also herein referred to as "upper inner bearing surfaces". Bearing surfaces 495, similar to bearing surfaces 485, mate with the outer bearing surfaces 480 to define the rotational degree of freedom Z of the rotor 105 relative to the base 475. Following disposal of the phase isolators 490 within the base 475, inner bearing surfaces 485, 495 surround the outer bearing surface 480 to restrain the rotor 105 within the base 475, while allowing the defined rotational degree of freedom Z of the rotor 105 relative to the base 475.

Furthermore, the set of phase isolators 490 are disposed such that blocking surfaces 500 are disposed adjacent to the blind holes 460, and the blocking surfaces 500 block, or close the blind holes 460. Therefore, the blocking surfaces 500 define a first limit of motion of the pin 465 in an axial direction 505 outward from the opening of the blind holes 460. Additionally, the bottom of the blind holes 460 include surfaces 510 opposite the blocking surfaces 500, and the surfaces 510 define a second limit of motion of the pin 465 in an axial direction 505 of the blind holes 460, toward the surfaces 510. Accordingly, subsequent to disposal of the pin 465 into the blind holes 460 and through the matching opening (best seen as pivot 365 in FIGS. 8 through 10) in the lower links 325, disposal of the blocking surfaces 500 of the phase isolators 490 captures the pin 465 within the blind holes 460.

Referring back now to FIG. 11, in an embodiment additional support of the rotor 105 within the base 475 is provided via end supports 515 engaged with ends 520, 525 (along the axial direction) of the rotor 105. In an embodiment, the pivot 420 of the rotor 105 is a recess 420 disposed within ends 520, 525 and the end support 515 includes protrusions 535 engagable within the recess 420. Variations of mating geometry of the protrusion 535 and recess 420 are contemplated, such as a cylinder 540, a cone 545, or a combination thereof, for example. Use of the cone 545 geometry is contemplated to provide a reduced amount of friction in response to rotation of the rotor 105. In an embodiment, the end supports 515 are secured to the base 475. The end supports 515 may be mechanically secured to the base 475 via fasteners, such as screws or rivets, or engagement features such as dovetails, for example. Alternatively, end supports 515 may be secured to the base via an adhesive or material transformation process, such as brazing or welding for example. In another embodiment, the end supports 515 or protrusions 535 may be integrated within the base 475. Use of the end supports 515 and the mating bearing surfaces 480, 485, 495, either exclusive of, or in conjunction with one another provide an arrangement for supporting and allowing rotation of the one piece rotor 105 within the base 475 absent a central pivot that extends through the plurality of contact arm modules 190, and therefore provide an increased dielectric strength, as described above in regard to isolation of the lower links 325.

As described above with reference to FIG. 10, the rotor 105 includes first stops 430 and the base 475 includes mating second stops 435. Although only one second stop 435 is visible in the perspective of FIG. 12, it will be appreciated that another mating second stop 435 is present proximate the inner bearing surface 485. The first stops 430 include a surface 550 and the second stops 435 include a surface 555 disposed such that the in response to the operating mechanism 65 being displaced to either the OFF or the TRIPPED position, the surfaces 550, 555 will be parallel and contact or engage each other, such that further rotor 105 rotation in the clockwise direction of FIGS. 9 and 10 will be restrained. Accordingly, the stops 430, 435 define a limit of the rotational degree of freedom Z of the rotor 105 relative to the base 475.

Figure 13:
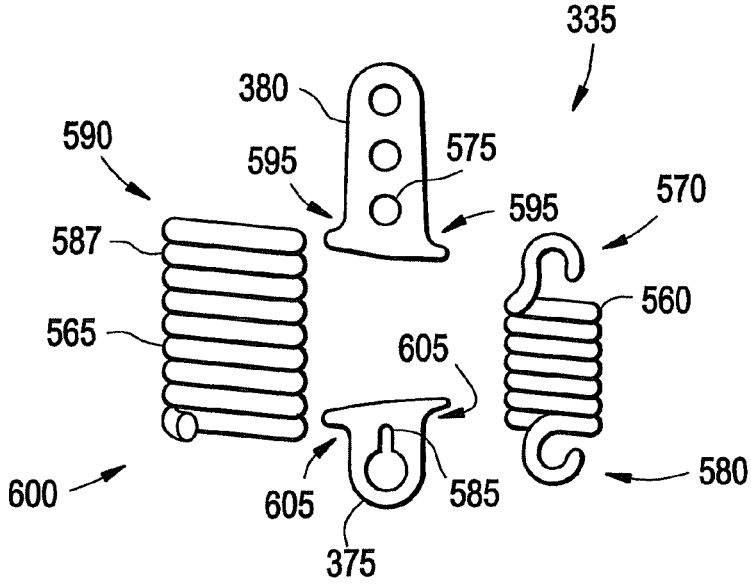
FIG. 13 depicts an exploded view of spring assembly components in accordance with an embodiment of the invention.

FIG. 13 depicts an exploded view of the components of the spring assembly 335, including the upper spring anchor 375, the lower spring anchor 380, a first extension spring 560, and a second extension spring 565. The first extension spring 560 includes a first end 570, such as a hook, in operable connection with the upper spring anchor via an opening 575 and a second end 580, such as another hook, in operable connection with the lower spring anchor 380 via an opening 585. The second extension spring 565 includes spring windings 587 that are disposed coaxial to and surrounding the first extension spring 560 and has a first end 590 in operable connection with the upper spring anchor 375 via a holder 595 disposed between two adjacent spring coil windings, for example. A second end 600 of the second extension spring 565 is in operable connection with the lower spring anchor 380 via a holder 605 disposed between two adjacent spring coil windings, for example. Use of the second extension spring 565 including the first extension spring 560 in parallel provides an increase in closing energy available to rotate the rotor 105 and the plurality of contact arm assemblies 190 to the CLOSED position, as described above. Disposal of the first extension spring 560 coaxially with, and within a center of the spring windings 587 of the second extension spring 565 increases the closing energy without increasing a total outer dimensional envelope corresponding to the second extension spring 565.

Figure 14:
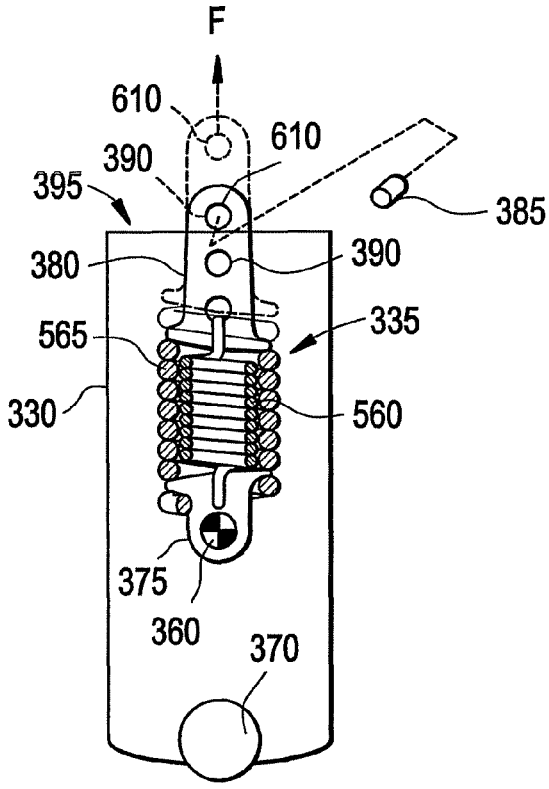
FIG. 14 depicts the spring assembly of FIG. 13 in relation to a handle yoke of an operating mechanism in accordance with an embodiment of the invention.

FIG. 14 depicts the relationship between the handle yoke 330, the spring assembly 335 and the toggle pivot 360 of the mechanism 65 in response to the mechanism being in the TRIPPED position, as shown in FIG. 10, with the springs 560, 565 in a free, or natural, unextended state. The upper spring anchor 375 includes a tool engagement feature 610, such as a hole or an opening. Following attachment of the lower spring anchor 380 to the toggle pin 360, with the toggle pin 360 disposed according to the TRIPPED position, a non-extended state of the springs 560, 565 yields a length of the spring assembly 335 such that the tool engagement feature 610 is disposed accessibly above, or protruding beyond the outer surface 395 of the handle yoke 330. With the tool engagement feature 610 disposed protruding beyond the outer surface 395, a tool (not specifically shown) may be engaged with the tool engagement feature 610 and utilized to apply a force F to extend the springs 560, 565.

The retention feature 390 is disposed beneath the outer surface 395 in response to the springs 560, 565 being in the free, unextended state. In response to the application of the force F extending the springs 560, 565, the upper spring anchor 375 is displaced upwardly, as shown in dashed lines. In response to application of an appropriate magnitude force F, the springs 560, 565 will be in an extended state, and the retention feature 390 disposed above, or protruding beyond the outer surface 395 of the handle yoke 330 in the same position as the tool engagement feature 610 depicted by solid line. Subsequent to extending the springs 560, 565 such that the retention feature 390 is disposed protruding beyond the outer surface 395, the engagement feature 385, such as a pin is disposed in contact with the retention feature 390 and the outer surface 395 of the handle yoke 330, to retain disposal of the retention feature 390 protruding beyond the outer surface 395 of the handle yoke 330. Accordingly, the springs 560, 565 are retained in the extended state and thereby provide the attractive bias force between the upper spring anchor 375 in operative connection with the handle yoke 330 and the lower spring anchor 380 in operative connection with the toggle pivot 360.

As disclosed, some embodiments of the invention may include some of the following advantages: increased isolation of the operating mechanism from the contact arms; increased isolation between contact arms modules of multiple phases of current; increased closing energy available within a given dimensional envelope; increased ease of assembly of spring assembly into the operating mechanism; increased dielectric strength between individual poles of a circuit breaker; and reduced contact resistance variation resulting from reduced depression variation between poles of a circuit breaker.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A circuit breaker subassembly comprising:

a base;

an operating mechanism disposed within the base;

a one-piece non-conductive rotor disposed within the base, the rotor having a rotational degree of freedom relative to the base and disposed in operable connection with the operating mechanism;

a plurality of sets of contact arms supported by the rotor, portions of the rotor disposed between each set of the plurality of sets of contact arms to define separation portions; and an end support, the end support engagable with at least one end of the one-piece non-conductive rotor along an axial direction thereof;

wherein the one-piece non-conductive rotor further comprises a recess disposed within the at least one end along the axial direction and the end support comprises a protrusion engagable within the recess; and wherein the operating mechanism comprises:

a frame disposed within the base;

a cradle in pivotal connection with the frame;

an upper link in pivotal connection with the cradle; and a lower link having a first end and a second end, the first end in pivotal connection with the upper link and the second end in pivotal connection with the rotor at the separation portions.

2. The circuit breaker subassembly of claim 1, further comprising:

a pin in pivotal connection with the second end of the lower link, the pin disposed within a hole of the separation portion of the rotor, the pin having a length less than a length of the separation portion measured along an axial direction of the rotor.

3. The circuit breaker subassembly of claim 1, wherein:

the frame comprises a first side and a second side; and the lower link is disposed between the first side and the second side.

4. The circuit breaker subassembly of claim 3, wherein the lower link is one of a plurality of lower links disposed between the first side and the second side.

5. The circuit breaker subassembly of claim 1, wherein:

the one piece non-conductive rotor further comprises a slot disposed within at least one of the separation portions of the rotor; and the second end of the lower link is disposed within the slot.

6. The circuit breaker subassembly of claim 1, wherein:

the rotor further comprises an outer bearing surface;

the base further comprises an inner bearing surface; and the outer bearing surface mates with the inner bearing surface, thereby defining the rotational degree of freedom of the rotor relative to the base.

7. The circuit breaker subassembly of claim 6, wherein the outer bearing surface is disposed between two sets of the plurality of sets of contact arms.

8. The circuit breaker subassembly of claim 7, wherein the inner bearing surface of the base comprises a lower inner surface, the circuit breaker subassembly further comprising:

a phase isolator disposed between the two sets of contact arms, the phase isolator comprising an upper inner bearing surface mating with the outer bearing surface.

9. The circuit breaker subassembly of claim 8, the circuit breaker subassembly further comprising:

a pin in pivotal connection with the second end of the lower link, the pin disposed within a hole of the separation portion of the rotor, the pin having a length less than a length of the separation portion measured along an axial direction of the rotor;

wherein the phase isolator comprises a blocking surface disposed adjacent to the hole, thereby defining a limit of motion of the pin in an axial direction of the hole.

10. The circuit breaker subassembly of claim 9, wherein:

the limit of motion comprises a first limit of motion;

the hole comprises a surface opposite the blocking surface; and the surface opposite the blocking surface defines a second limit of motion of the pin in the axial direction of the hole.

11. The circuit breaker subassembly of claim 1, wherein:

the rotor further comprises a first stop;

the base further comprises a second stop; and the first stop and the second stop define a limit of the rotational degree of freedom of the rotor relative to the base.

12. The circuit breaker subassembly of claim 1, wherein a geometry of the protrusion comprises at least one of a cylinder, a cone, or a combination thereof.

13. The circuit breaker subassembly of claim 1, wherein:

the cradle is in pivotal connection with the frame via a first pivot;

the lower link is in pivotal connection with the upper link via a toggle pin;

the operating mechanism further comprises:

a handle yoke in pivotal connection with the frame via a second pivot; and a spring assembly comprising:

an upper spring anchor operably connectable with the handle yoke;

a lower spring anchor in operable connection with the toggle pin;

a first extension spring having a first end in operable connection with the upper spring anchor and a second end in operable connection with the lower spring anchor; and a second extension spring disposed coaxial to and having spring windings surrounding the first extension spring, the second extension spring having a first end in operable connection with the upper spring anchor and a second end in operable connection with the lower spring anchor.

14. A circuit breaker operating mechanism comprising:

a frame;

a cradle in pivotal connection with the frame via a first pivot;

an upper link in pivotal connection with the cradle;

a lower link in pivotal connection with the upper link via a toggle pin;

a handle yoke in pivotal connection with the frame via a second pivot; and a spring assembly comprising:

an upper spring anchor operably connectable with the handle yoke;

a lower spring anchor in operable connection with the toggle pin;

a first extension spring having a first end in operable connection with the upper spring anchor and a second end in operable connection with the lower spring anchor; and a second extension spring disposed coaxial to and having spring windings surrounding the first extension spring, the second extension spring having a first end in operable connection with the upper spring anchor and a second end in operable connection with the lower spring anchor;

wherein the upper spring anchor comprises a retention feature, such that the retention feature is disposed protruding beyond an outer surface of the handle yoke in response to the lower spring anchor being in operable connection with the toggle pin and the first and second extension springs being in an extended state.

15. The operating mechanism of claim 14, wherein the upper spring anchor further comprises a tool engagement feature disposed accessibly above the outer surface of the handle yoke in response to the lower spring anchor being in operable connection with the toggle pin and the first and second extension springs being in a non-extended state.

16. The operating mechanism of claim 15, further comprising:

an engagement feature disposed in contact with the retention feature of the upper spring anchor and the outer surface of the handle yoke thereby retaining the retention feature protruding beyond the outer surface of the handle yoke.

17. The operating mechanism of claim 16, wherein the engagement feature is a pin.

* * * * *